US011209024B2

(12) United States Patent
Switzer et al.

(10) Patent No.: US 11,209,024 B2
(45) Date of Patent: Dec. 28, 2021

(54) DISCHARGE CASING INSERT FOR PUMP PERFORMANCE CHARACTERISTICS CONTROL

(71) Applicant: ITT Manufacturing Enterprises LLC., Wilmington, DE (US)

(72) Inventors: Matthew Switzer, Waterloo, NY (US); David Skinner, Waterloo, NY (US); Simon Bradshaw, Seneca Falls, NY (US); Mark Hall, Canandaigua, NY (US)

(73) Assignee: ITT Manufacturing Enterprises LLC, Wilmington, DE (US)

( * ) Notice: Subject to any disclaimer, the term of this patent is extended or adjusted under 35 U.S.C. 154(b) by 1278 days.

(21) Appl. No.: 14/748,896

(22) Filed: Jun. 24, 2015

(65) Prior Publication Data

US 2016/0377095 A1 Dec. 29, 2016

(51) Int. Cl.
*F04F 5/46* (2006.01)
*F04F 5/02* (2006.01)
(Continued)

(52) U.S. Cl.
CPC ..... *F04F 5/46* (2013.01); *F01C 21/10* (2013.01); *F04C 23/005* (2013.01); *F04F 5/00* (2013.01); *F04F 5/02* (2013.01)

(58) Field of Classification Search
CPC ..... F04B 11/0091; F04B 39/0038; F04B 39/0055; F04B 49/22; F04B 49/225;
(Continued)

(56) References Cited

U.S. PATENT DOCUMENTS 1,801,520 A 4/1931 Mcmahon
2,076,465 A * 4/1937 Kirk ..... F16L 55/027 138/44
(Continued)

FOREIGN PATENT DOCUMENTS

CN 102812256 A 12/2012
CN 104470640 A 3/2015
(Continued)

OTHER PUBLICATIONS

"Diffusers," Vortex™, www.vortexventures.com http://www.vortexventures.com/systems-products/spare-partsoperationand-installation-manuals/diffusers.html Discloses parabolic converging section centralizes the flow from the nozzle into the venturi throat, increases the flow velocity, creating a low pressure area and strong vacuum in the mixing chamber. [Copyright Date is "2013"].
(Continued)

*Primary Examiner* — Dominick L Plakkoottam
*Assistant Examiner* — Charles W Nichols
(74) *Attorney, Agent, or Firm* — Hertzberg, Turk & Associates, LLC

(57) ABSTRACT

Apparatus, e.g., including a pump or rotary device, having a discharge casing and a discharge casing insert. The discharge casing may be configured with a discharge flow pathway for providing a flow of effluent being pumped and discharged, the discharge flow pathway having a discharge flow pathway wall, the discharge casing also configured with a discharge casing insert borehole that passes from an outer surface of the discharge casing through the discharge flow pathway wall. The discharge casing insert may include a discharge casing Venturi plug portion to be received in the discharge casing insert borehole and arranged in the discharge flow pathway, the discharge casing Venturi plug portion configured with a restricted discharge flow pathway
(Continued)

for providing a partial obstruction in the discharge flow pathway and the flow of the effluent being pumped and discharged.

19 Claims, 6 Drawing Sheets

(51) Int. Cl.
*F01C 21/10* (2006.01)
*F04C 23/00* (2006.01)
*F04F 5/00* (2006.01)

(58) Field of Classification Search
CPC ..... F04B 2201/06; F04B 2201/062; F04B 2205/172; F04C 14/24; F04C 15/06; F04C 28/24; F04C 29/12; F04C 2250/102; F04C 23/005; F04D 15/0005; F04D 15/0022; F04D 27/002; F04D 27/0246; F04D 27/0253; F04D 27/003; F04D 29/44; F04F 5/54; F04F 5/00; F04F 5/02; F04F 5/46; F01C 21/10
See application file for complete search history.

(56) References Cited

U.S. PATENT DOCUMENTS

| | | | | |
|---|---|---|---|---|
| 2,286,613 | A | 6/1942 | Fuller | |
| 2,478,941 | A | 8/1949 | Piccardo | |
| 2,489,636 | A | 11/1949 | Gurley | |
| 2,810,346 | A | 10/1957 | Lung | |
| 2,943,705 | A * | 7/1960 | Staunt | A61C 1/181 184/55.2 |
| 3,720,482 | A | 3/1973 | Tell | |
| 4,135,861 | A | 1/1979 | Brown et al. | |
| 4,210,166 | A | 7/1980 | Munie | |
| 4,280,662 | A | 7/1981 | Erickson et al. | |
| 4,298,018 | A | 11/1981 | Haggard | |
| 4,395,201 | A | 7/1983 | Bron | |
| D289,003 | S | 3/1987 | Koziol | |
| D297,560 | S | 9/1988 | LeBreton | |
| 4,827,987 | A | 5/1989 | Faeth | |
| 4,921,406 | A | 5/1990 | Burger | |
| D317,997 | S | 7/1991 | Koziol | |
| 5,083,609 | A | 1/1992 | Coleman | |
| 5,342,183 | A * | 8/1994 | Rafalovich | F04C 29/12 418/15 |
| 6,024,129 | A | 2/2000 | Schima | |
| 6,354,371 | B1 | 3/2002 | O'Blanc | |
| 6,609,638 | B1 | 8/2003 | Lott | |
| 6,638,043 | B1 * | 10/2003 | Khalifa | F04C 18/16 415/207 |
| 7,074,274 | B1 | 7/2006 | Shutic et al. | |
| 7,347,259 | B2 | 3/2008 | Ravensbergen et al. | |
| 7,524,466 | B2 | 4/2009 | Long | |
| 8,200,048 | B2 | 6/2012 | Vidal et al. | |
| 8,377,385 | B2 | 2/2013 | Long | |
| 8,622,715 | B1 | 1/2014 | Lott et al. | |
| 2008/0145260 | A1 * | 6/2008 | Sevic | F04C 2/3442 418/159 |
| 2017/0058731 | A1 * | 3/2017 | Fletcher | F01M 13/028 |

FOREIGN PATENT DOCUMENTS

| | | |
|---|---|---|
| DE | 37 21 611 A1 | 1/1989 |
| EP | 0961022 | 12/1999 |
| EP | 1609990 A1 | 12/2005 |
| FR | 2170637 A5 | 9/1973 |
| GB | 1410981 | 10/1975 |
| GB | 2033011 A | 5/1980 |
| JP | 11351200 | 12/1999 |
| WO | 2013003958 | 1/2013 |

OTHER PUBLICATIONS

"Powder Pump Venturi Parts," Hangzhou Color Powder coating Equipment co., ltd., Model No. colo-v, www.powdergunparts.com http://www.powdergunparts.com/products/powder-pump-venturi-parts-1497618.html Discloses insert venturi (hose connector/ hose fitting/pump connector), High Density Teflon offers longer service life and resistance to impact fusion (hard powder build-up). [Internet Download, No Date on Document Re Content].

Michael, Eric, "New Info on Alpha Cone Skimmer, External Model to Come," glassbox-design.com, Apr. 14, 2009. http://glassbox-design.com/2009/new-info-on-alpha-cone-skimmerexternal- model-to-come/ Discloses Venturi with the 1500lph insert already placed inside, allow for the original 1500lph or an increased 1800lph of air intake; swap is quick, easy, and near impossible to screw up.

JP11351200 English Language Abstract (1page).

* cited by examiner

Sample test data for two venturi sizes in the same 3700LF 1x2-12A Casing

DISCHARGE CASING INSERT FOR PUMP PERFORMANCE CHARACTERISTICS CONTROL

BACKGROUND OF THE INVENTION

1. Field of the Invention

This application relates to a pump or rotary device; and more particularly to a discharge casing of a pump or rotary device.

2. Brief Description of Related Art

The current standard for venturi casings is to drill and ream a discharge passageway due to low specific speed pumps' sensitivity to passage quality. A higher quality passage can be created by machining rather than using an as-cast surface. It is also known to cross drill a bypass from the discharge to the casing annulus which provides an enhanced curved shape. The bypass also improves the curve stability as well.

However, classic venturi designs are difficult to manufacture due to long drilling with relatively small drill bits. This creates a lot of machining deviation that greatly effects pump performance and first pass yield. This machining deviation is largely due to the pump's design rather than manufacturing issues causing an additional rework to achieve a required performance. Traditional venturi designs also limit a casing to having one throat size without requiring a remachine or a new casing (if going to a smaller throat size). Traditional venturi throats will experience wear over time and cause the effective throat area to increase. Significant wear can lead to performance changes which can necessitate costly casing rework or replacement.

In view of this, there is a need in the industry for a better way to configure a discharge passageway with a Venturi implementation.

SUMMARY OF THE INVENTION

In summary, the difficulties of manufacturing classic venturi designs are solved with a new and unique discharge casing insert according to the present invention, e.g., that allows for larger bores to be drilled into the discharge and utilizing a discharge casing insert to control the minimum throat area required for proper performance characteristics of the pump. The larger discharge bore reduces pipe losses and also minimizes potential manufacturing defects often associated with small bits at long drill depths. The design of the new and unique discharge casing insert keeps tighter tolerance portions contained within it and allows for looser tolerance in the casing machining processes. Since the new discharge casing insert may be interchangeable, it also allows for throat changes in the aftermarket by simply replacing the discharge casing insert being used with one of a different throat area, thus allowing customers to change pump performance characteristics in the field. The new discharge casing insert also allows for a customer to easily change the pump's performance in the case of a worn out throat area. Being interchangeable, the new discharge casing insert can also be made in different materials than the rest of the casing for improved material properties or wear resistance.

In effect, the new discharge casing insert according to the present invention works by containing the pump throat area within the discharge casing insert itself rather than the traditional drilled-style found in current venturi casings. By containing the throat in the insert, the new discharge casing insert greatly improves the manufacturability of the pump and gives more customer control over pump performance. By way of example, and consistent with that set forth above, the discharge case may be manufactured (i.e., drilled) with a larger-sized bore to receive the discharge casing insert that is configured to control the throat area for providing certain performance characteristics of the pump. In the aftermarket, the customer may remove the discharge casing insert and replace it with a different discharge casing insert that is received in the same larger bore, but has a different throat area to change the performance characteristics of the pump. In addition, the number of casing configurations is also reduced allowing for stocking of machined casings and the customizing of the discharge performance of a customer's order by only changing the geometry of the new discharge casing insert. This also gives a customer the option to re-rate their pump in the field by purchasing a new discharge casing insert, allowing their installations to be more dynamic. As the discharge casing wears with use, a standard drilled venturi casing would need to be replaced to restore lost performance, but the new discharge casing insert according to the present invention allows for easy performance restoration thus increasing the useful life of the casing.

The new discharge casing insert contains geometry which defines the throat area, or flow restriction point, of the pump. This geometry is inserted into the larger bore discharge drilling and acts as the choke point for the discharge of effluent from the pump.

By way of example, discharge casing inserts can either have built in sealing mechanisms to seal the casing or require additional hardware to seal them into the casing. Some embodiments disclosed herein provide a new discharge casing insert which contains a built in flange for assembly to the discharge casing, while other embodiments disclosed herein provide a new discharge casing insert which uses an external sealing and assembly feature to seal it within the discharge casing.

The present invention is intended to cover the use of any discharge casing insert which may be placed in the discharge flow path to alter pump performance by means of obstruction in flow or reduced cross section.

By way of one example, the design of the new discharge casing insert may include, take the form of, or use a variable sized or shaped pin to restrict the flow and create the proper "throat area" and performance characteristics. The geometry of the new discharge casing insert may be round or have other geometry which effects pump performance.

Other discharge casing insert designs may include inserts having an angled inlet and exit geometry with a drilled throat geometry. This design may also contain a drill through to tap into the bypass drilling of the pump for improved performance in high recirculation conditions.

In effect, the new discharge casing insert provides a better way to configure a discharge passageway with a Venturi implementation, and is an important contribution to the state of the art and the pump or rotary device industry as a whole.

The Apparatus

According to some embodiments, the present invention may take the form of apparatus, e.g., including a pump or rotary device, featuring a discharge casing in combination with a new and unique discharge casing insert. The discharge casing may be configured with a discharge flow pathway for providing a flow of effluent being pumped and discharged, the discharge flow pathway having a discharge flow pathway wall, the discharge casing also configured with a discharge casing borehole that passes from an outer surface of the discharge casing through the discharge flow pathway wall. The discharge casing insert may include a discharge casing Venturi plug portion to be received in the discharge casing borehole and arranged in the discharge flow pathway, the discharge casing Venturi plug portion configured with a restricted discharge flow pathway for providing a partial obstruction in the discharge flow pathway and the flow of the effluent being pumped and discharged.

The apparatus may include one or more of the following features:

The discharge flow pathway has a cross-section, and the discharge casing Venturi plug portion may be configured with a corresponding discharge flow pathway, one part or section of which has a corresponding cross-section that is substantially the same as the cross-section of the discharge flow pathway, and another part or section of which has a reduced cross-section that is less than the cross-section of the discharge flow pathway.

Dowel Pin Arrangements

Some embodiments may include the discharge casing Venturi plug portion having a dowel pin configured therein, e.g., for providing the partial obstruction in the discharge flow pathway and the flow of the effluent being pumped and discharged from the discharge casing.

By way of example, the discharge casing Venturi plug portion may be configured with a dowel pin bore; and the discharge casing Venturi plug portion may include a dowel pin configured to be received in the dowel pin bore, so as to configure the restricted discharge flow pathway to provide the partial obstruction in the discharge flow pathway and the flow of the effluent being pumped and discharged.

The dowel pin may be arranged in the dowel pin bore, so as to restrict some part of section of the corresponding discharge flow pathway and provide the partial obstruction in the discharge flow pathway and the flow of the effluent being pumped and discharged.

In some embodiments, the dowel pin may be configured as a rod (e.g., a solid rod) having a shaft with a reduced diameter that is less than the cross-section of the discharge flow pathway, so as to restrict some part or section of the corresponding discharge flow pathway and provide the partial obstruction in the discharge flow pathway and the flow of the effluent being pumped and discharged.

In other embodiments, the dowel pin may be configured with an orifice having a reduced cross-section that is less than the cross-section of the discharge flow pathway, so as to restrict some part or section of the corresponding discharge flow pathway and provide the partial obstruction in the discharge flow pathway and the flow of the effluent being pumped and discharged.

The discharge casing insert may include a set of dowel pins, where each dowel pin may be configured to be received in the dowel pin bore, and where each dowel pin may also be configured to provide a different-sized partial obstruction in the discharge flow pathway and the flow of the effluent being pumped and discharged, so that performance of the pump may be adjusted based upon the selection of which dowel pin is used from the set of dowel pins so as to provide a desired throat area.

In some embodiments, each dowel pin may be configured with a respective shaft having a different diameter, where a dowel pin having a larger diameter causes a larger partial obstruction in the discharge flow pathway and the flow of the effluent being pumped and discharged, and where a corresponding dowel pin having a smaller diameter causes a smaller partial obstruction in the discharge flow pathway and the flow of the effluent being pumped and discharged.

Alternatively, each dowel pin may be configured with a respective orifice having a respective diameter that causes a respective partial obstruction in the discharge flow pathway and the flow of the effluent being pumped and discharged. By way of example, the set of dowel pins may include a first dowel pin having a first orifice with a first diameter that causes a first partial obstruction in the discharge flow pathway and the flow of the effluent being pumped and discharged, and may also include a second dowel pin having a second orifice with a second diameter that is different from the first diameter and that causes a different-sized partial obstruction than the first partial obstruction in the discharge flow pathway and the flow of the effluent being pumped and discharged. In effect, the partial obstruction forms a restricted discharge flow pathway that may be configured with a geometry and/or variables shapes, e.g., that may include, but not be limited to, either a round geometry or shape, a triangular geometry or shape. a rectangular geometry or shape, a square geometry or shaped, or an oval geometry or shape.

Integrally Formed Inlet Arrangements

Some embodiment may include the discharge casing Venturi plug portion configured with an inlet/opening that may be drilled or integrally formed therein, e.g., for providing the partial obstruction in the discharge flow pathway and the flow of the effluent being pumped and discharged from the discharge casing.

By way of example, the inlet/opening may be configured or formed having a reduced cross-section that is less than the cross-section of the discharge flow pathway, so as to restrict some part or section of the corresponding discharge flow pathway and provide the partial obstruction in the discharge flow pathway and the flow of the effluent being pumped and discharged.

The orifice may be configured, shaped or formed with an inlet portion having a reduced cross-section that is less than the cross-section of the discharge flow pathway, and an expanding conical portion having a cross-section that is less than, the same, or larger than the cross-section of the discharge flow pathway.

The orifice may also be configured, shaped or formed with an expanding portion that may have a larger cross-section than the cross-section of the discharge flow pathway, an inlet portion having a reduced cross-section that is less than the cross-section of the discharge flow pathway, and also an expanding conical portion having a cross-section that is less than, the same, or larger than the cross-section of the discharge flow pathway.

The apparatus may include a set of discharge casing inserts, where each discharge casing insert has a respective discharge casing Venturi plug portion configured to be received in the dowel pin bore, and where each discharge casing Venturi plug portion may also be configured to provide a different-sized partial obstruction in the discharge flow pathway and the flow of the effluent being pumped and discharged, so that performance of the pump may be adjusted based upon the selection of which discharge casing Venturi plug portion is used from the set so as to provide a desired throat area.

In some embodiments, each discharge casing Venturi plug portion may be configured with a respective orifice having a respective diameter that causes a respective partial obstruction in the discharge flow pathway and the flow of the effluent being pumped and discharged. For example, the set of discharge casing inserts may include a first discharge casing Venturi plug portion configured with a first diameter orifice having a first diameter that causes a first partial obstruction in the discharge flow pathway and the flow of the effluent being pumped and discharged, and may also include a second discharge casing Venturi plug portion configured with a second orifice with a second diameter that is different from the first diameter and that causes a different-sized partial obstruction than the first partial obstruction in the discharge flow pathway and the flow of the effluent being pumped and discharged. Consistent with that set forth above, the partial obstruction forms a restricted discharge flow pathway that may be configured with a geometry and/or variables shapes, e.g., that may include, but not be limited to, either a round geometry or shape, a triangular geometry or shape. a rectangular geometry or shape, a square geometry or shaped, or an oval geometry or shape.

BRIEF DESCRIPTION OF THE DRAWING

The drawing, not necessarily drawn to scale, includes the following Figures:

FIG. 1 includes FIGS. 1A and 1B, where

FIG. 2 includes FIGS. 2A, 2B, 2C and 2D, where

FIG. 3 includes FIGS. 3A, 3B, 3C and 3D, where

FIG. 4 includes FIGS. 4A, 4B and 4C, where

FIG. 5 includes FIGS. 5A, 5B and 5C, where

FIG. 6 includes FIGS. 6A and 6B, where

Figure 1A:
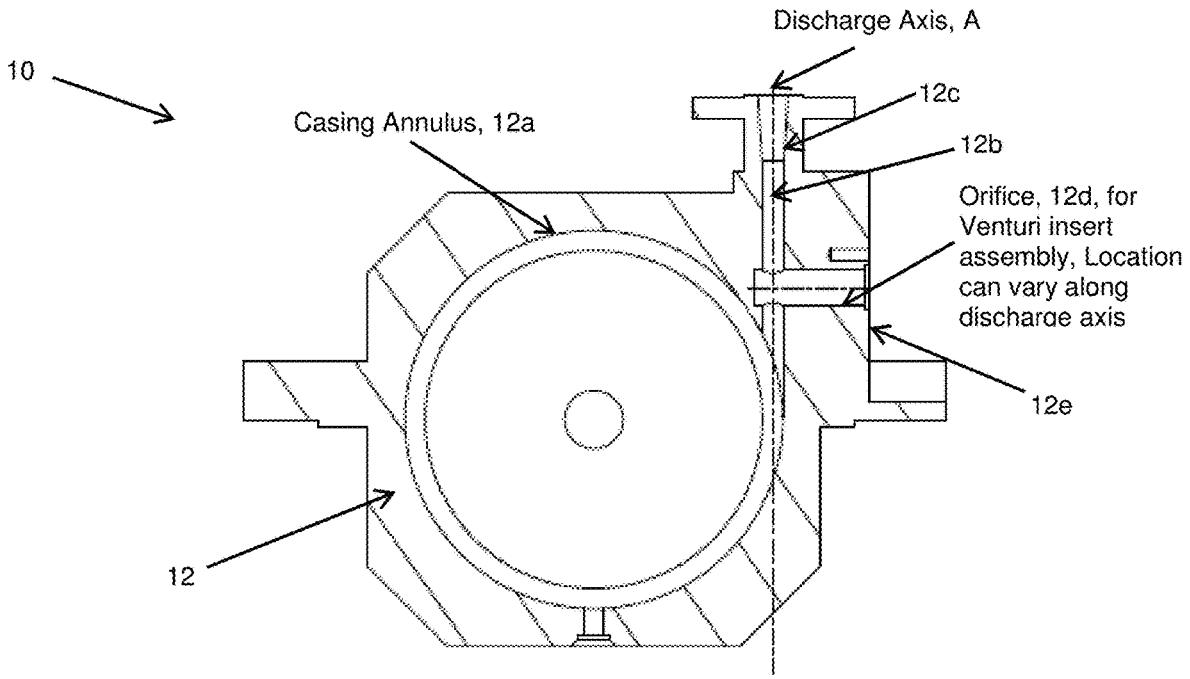
FIG. 1A is a diagram of a discharge casing having a discharge casing borehole.

Not every reference numeral is included in every Figure, e.g., so as to reduce clutter in the drawing as a whole.

DETAILED DESCRIPTION OF THE INVENTION

FIG. 1: The Basic Apparatus 10

Figure 1B:
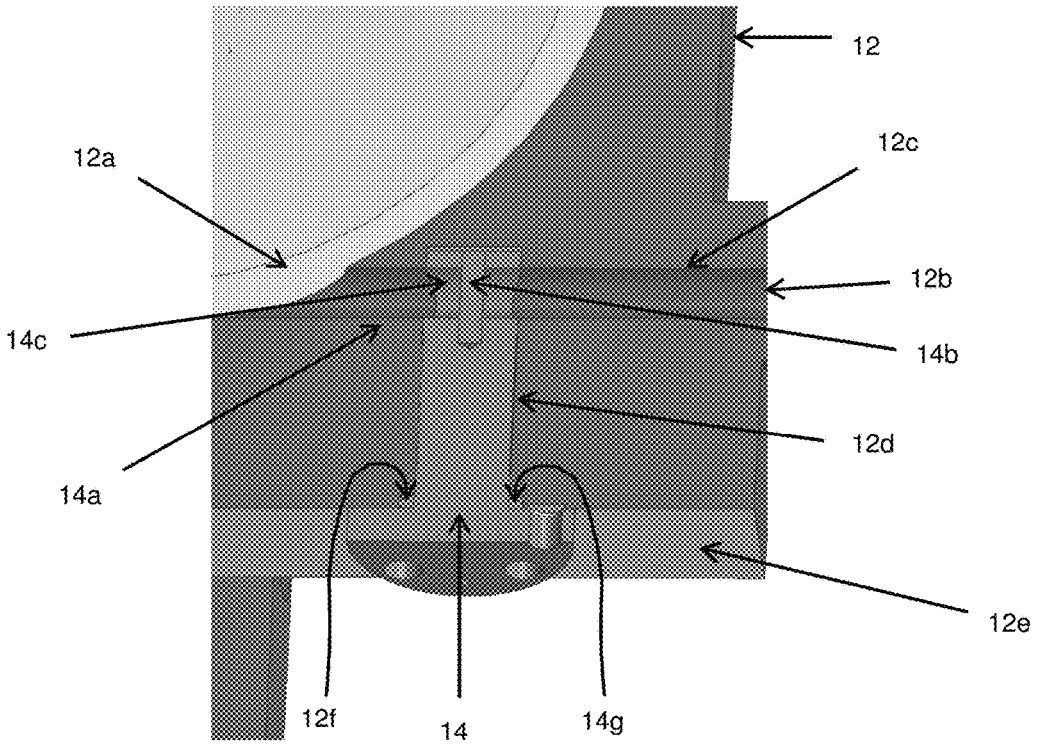
FIG. 1B is a diagram of a discharge casing having a discharge casing insert arranged in the discharge casing borehole shown in FIG. 1A, according to some embodiments of the present invention.
Figure 2A:
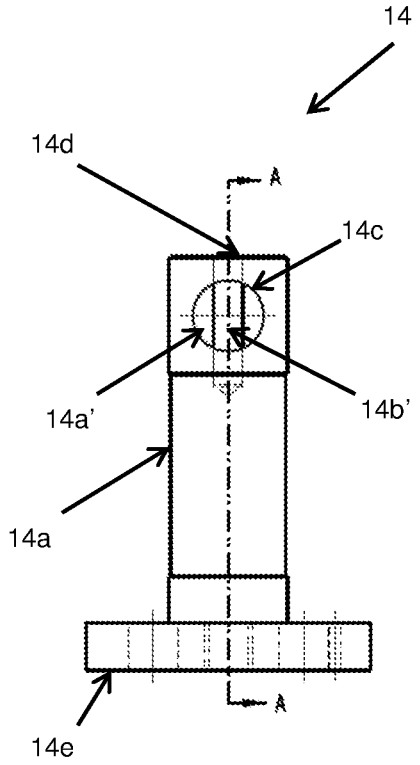
FIG. 2A is a diagram of a side view of a discharge casing insert looking through the discharge flow pathway of the discharge casing insert.
Figure 2B:
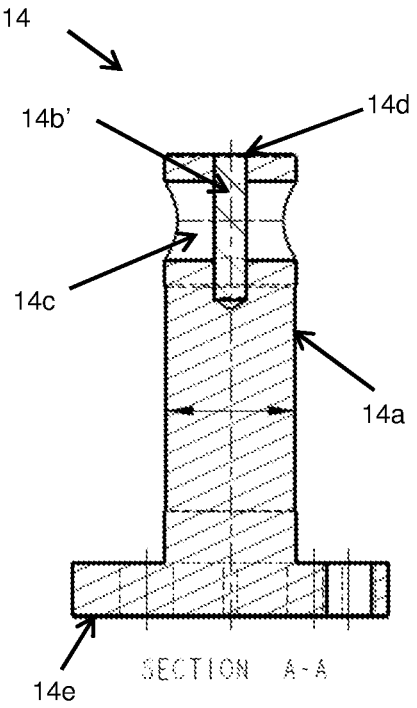
FIG. 2B is a cross-sectional view along lines A-A of the discharge casing insert shown in FIG. 2A.
Figure 2C:
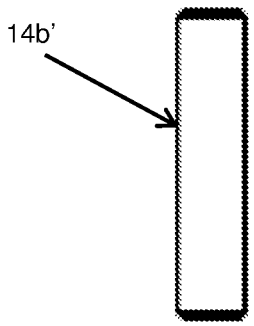
FIG. 2C is a diagram of a pin dowel that forms part of the discharge casing insert shown in FIGS. 2A and 2B.
Figure 2D:
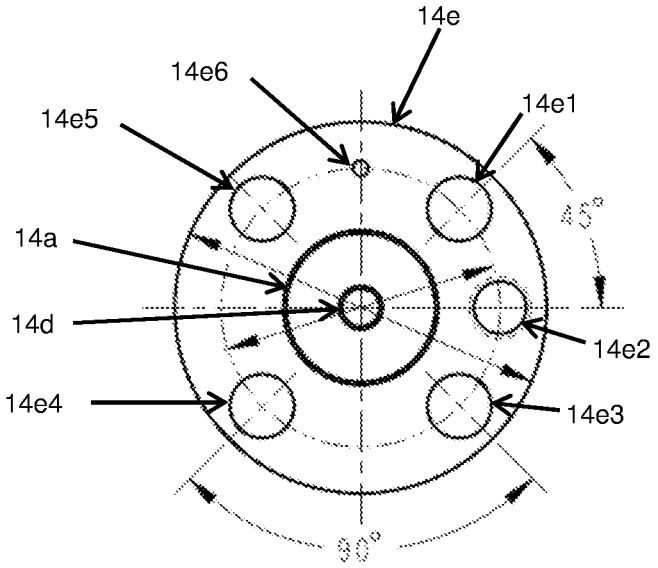
FIG. 2D is a diagram of a bottom view of the discharge casing insert shown in FIGS. 2A and 2B, according to some embodiments of the present invention.
Figure 3A:
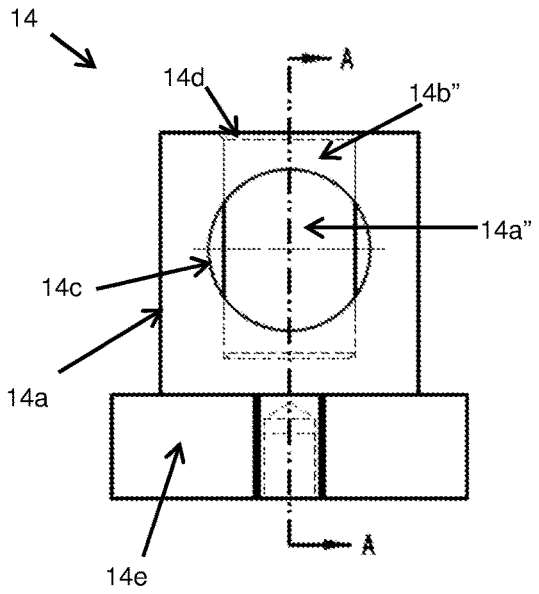
FIG. 3A is a diagram of a side view of a discharge casing insert looking through the discharge flow pathway of the discharge casing insert.
Figure 3B:
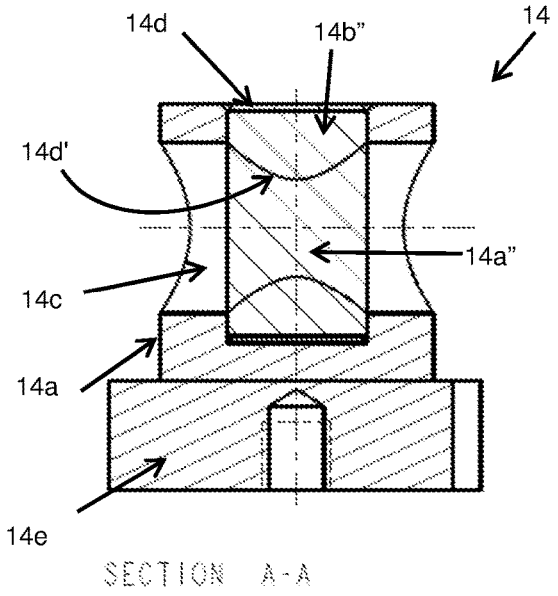
FIG. 3B is a cross-sectional view along lines A-A of the discharge casing insert shown in FIG. 3A.
Figure 3C:
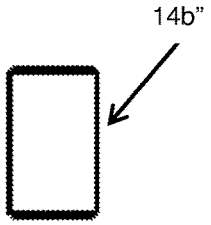
FIG. 3C is a diagram of a pin dowel that forms part of the discharge casing insert shown in FIGS. 3A and 3B.
Figure 3D:
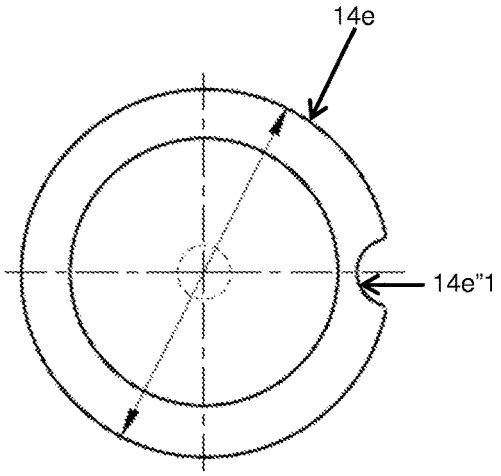
FIG. 3D is a diagram of a top view of the discharge casing insert shown in FIGS. 3A and 3B.
Figure 4A:
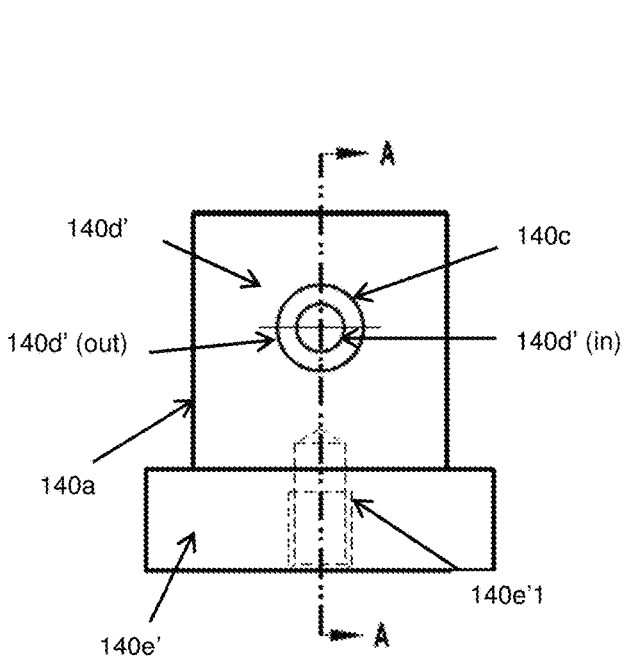
FIG. 4A is a diagram of a side view of a discharge casing insert.
Figure 4B:
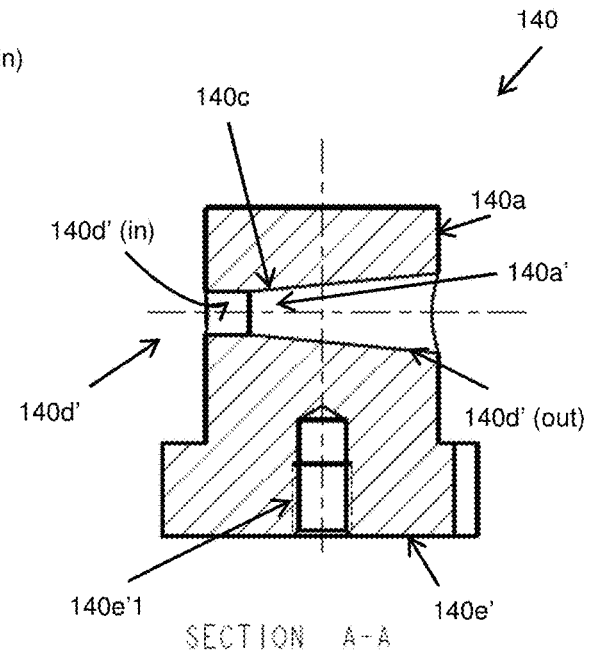
FIG. 4B is a cross-sectional view along lines A-A of the discharge casing insert shown in FIG. 4A.
Figure 4C:
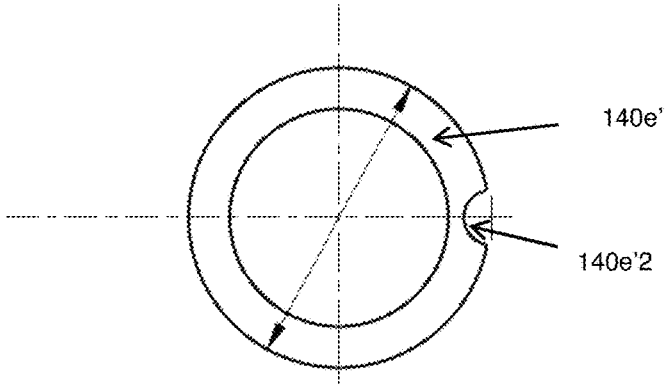
FIG. 4C is a diagram of a top view of the discharge casing insert shown in FIGS. 4A and 4B.
Figure 5A:
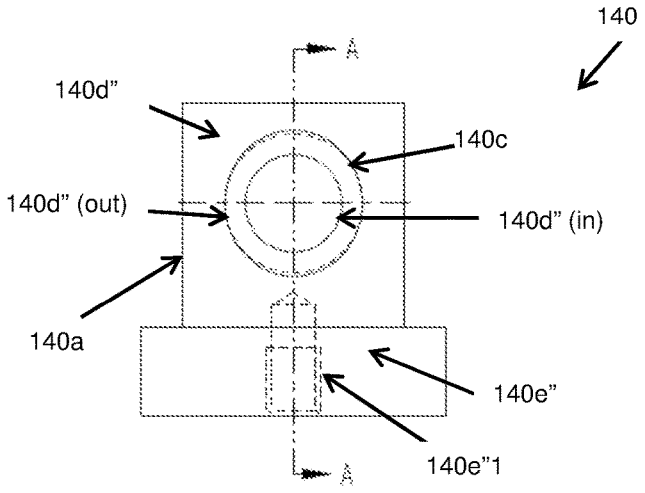
FIG. 5A is a diagram of a side view of a discharge casing insert.
Figure 5B:
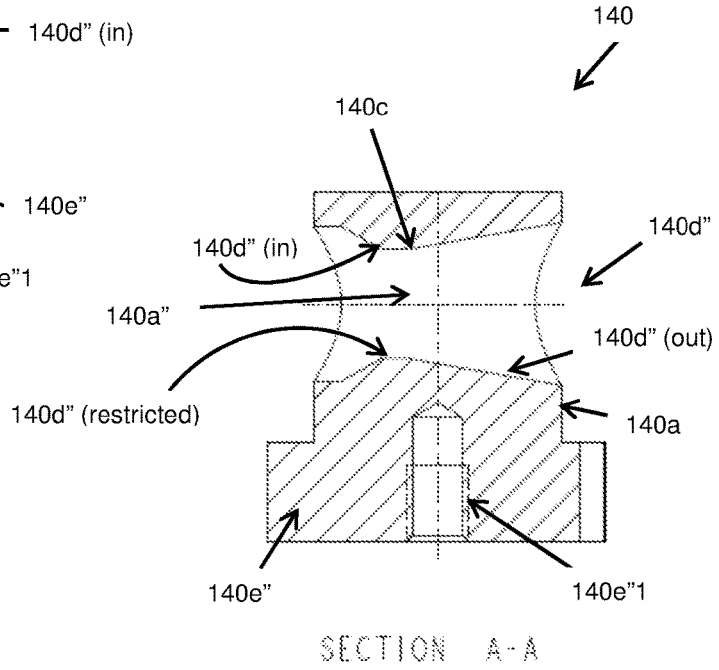
FIG. 5B is a cross-sectional view along lines A-A of the discharge casing insert shown in FIG. 5A.
Figure 5C:
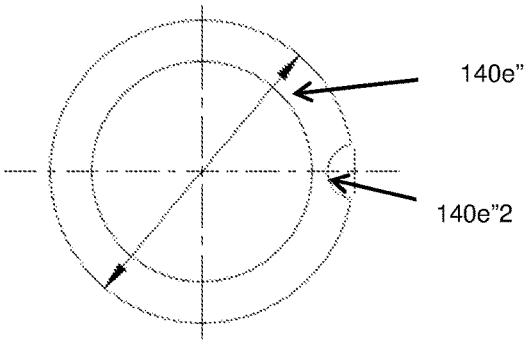
FIG. 5C is a diagram of a top view of the discharge casing insert shown in FIGS. 5A and 5B.
Figure 6A:
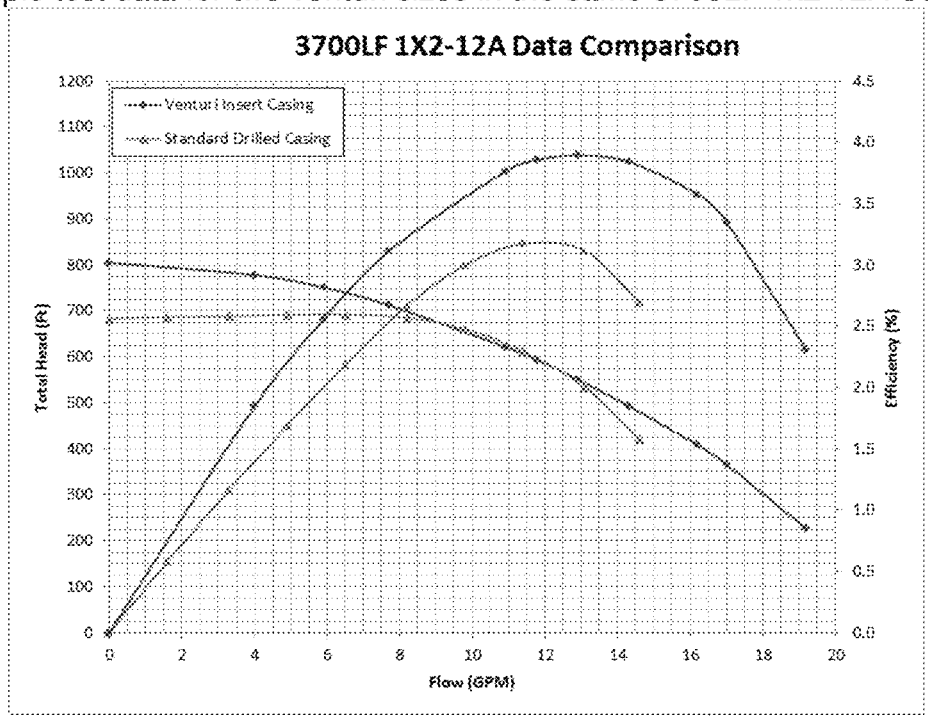
FIG. 6A is graph of a data comparison of sample test data for two venturi sizes, one for a Venturi insert casing, and the other for a standard drilled casing, based upon total head (Ft), flow (GPM) and efficiency (%); and where
Figure 6B:
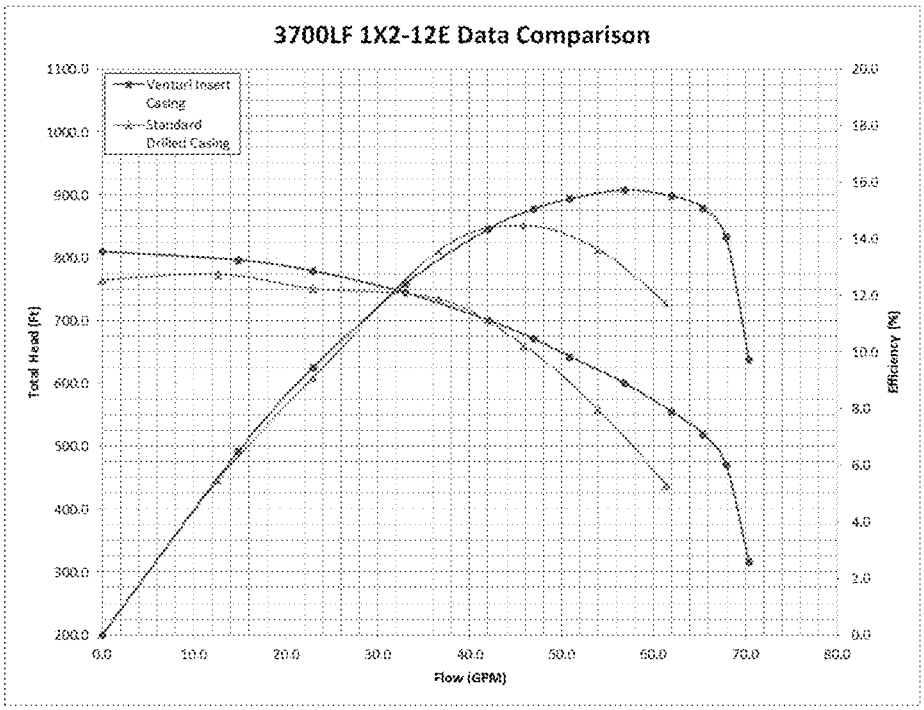
FIG. 6B is also graph of a data comparison of sample test data for two venturi sizes, one for a Venturi insert casing, and the other for a standard drilled casing, based upon total head (Ft), flow (GPM) and efficiency (%).

According to some embodiments, the present invention may take the form of apparatus, e.g., including a pump or rotary device, having a discharge casing part shown in FIGS. 1A and 1B and generally indicated as 10, that features a discharge casing 12 in combination with a discharge casing insert 14 (see FIGS. 1B, 2 and 3), 140 (see FIGS. 4 and 5). The discharge casing 12 may include a discharge casing annulus 12*a*. FIG. 1A shows the discharge casing 12 without the discharge casing insert 14, while FIG. 1B shows the discharge casing 12 with the discharge casing insert 14 configured therein.

The discharge casing 12 may be configured with a discharge flow pathway 12*b* for providing a flow of effluent being pumped and discharged. The discharge flow pathway 12*b* may have a discharge flow pathway wall 12*c*, and is shown with a discharge axis A. The discharge casing 12 may also be configured with a discharge casing insert borehole or orifice 12*d* that passes from an outer surface 12*e* of the discharge casing 12 through the discharge flow pathway wall 12*c*.

The discharge casing insert 14, 140 may include, or be configured with, a discharge casing Venturi plug portion generally indicated as 14*a* (see FIGS. 1B, 2 and 3), 140*a* (FIGS. 4 and 5) to be received in the discharge casing insert borehole 12*d* and arranged at least in part in the discharge flow pathway 12*b*, e.g., consistent with that shown in FIG. 1B. The discharge casing Venturi plug portion 14*a*, 140*a* may be configured with a restricted discharge flow pathway, e.g., which is generally indicated as 14*a*' and 14*a*" (see FIGS. 2A, 3A, 3B), 140*a*' and 140*a*" (see FIGS. 4B and 5B), for providing a partial obstruction in the discharge flow pathway 12*b* and the flow of the effluent being pumped and discharged from the discharge casing 12.

FIG. 1B shows an embodiment of the present that is consistent with that shown in FIGS. 2 and 3, where the discharge casing Venturi plug portion 14*a* includes a dowel pin 14*b*. 14*b*', 14*b*" configured therein, e.g., for providing the partial obstruction in the discharge flow pathway 12*b* and the flow of the effluent being pumped and discharged from the discharge casing 12. In FIG. 1B, the discharge casing Venturi plug portion 14*a* may be configured with a corresponding discharge flow pathway 14*c* (or 140*c* in FIGS. 4 and 5), e.g., having a part or section with a cross-section that may be substantially the same as the cross-section of the discharge flow pathway 12*b*, and some part or section of the corresponding discharge flow pathway 14*c* configured with a reduced cross-section that is less than the cross-section of the discharge flow pathway 12*b*, as set forth herein. Consistent with that shown in FIGS. 2A and 3A, outer parts or sections of the corresponding discharge flow pathway 14*c* have the cross-section that is substantially the same as the cross-section of the discharge flow pathway 12*b*, and an intermediate or middle part or section of the corresponding discharge flow pathway 14*c* may be configured with the reduced cross-section that is less than the cross-section of the discharge flow pathway 12*b*, as set forth herein.

In comparison, FIGS. 4 and 5 show embodiments of the discharge casing Venturi plug portion 140*a* having an inlet, opening or orifice configured or integrally formed therein, e.g., for providing the partial obstruction in the discharge flow pathway 12*b* and the flow of the effluent being pumped and discharged from the discharge casing. Consistent with that shown in FIGS. 4A, 4B and 5A, 5B, the discharge casing Venturi plug portion 140*a* may be configured with one or more parts or sections of the corresponding discharge flow pathway 140*c* having a cross-section that is substantially the same as the cross-section of the discharge flow pathway 12*b*, and some part or section of the corresponding discharge flow pathway 140*c* configured with a reduced cross-section that is less than the cross-section of the discharge flow pathway 12*b*, as set forth herein.

By way of example, the discharge casing insert borehole or orifice 12*d* may be configured along the discharge flow pathway 12*b* in a position or location as shown in FIG. 1 for receiving the discharge casing insert 14. However, the scope of the invention is intended to include, and embodiments are envisioned in which, the discharge casing insert borehole or orifice 12*d* and the discharge casing insert 14 being configured at a different position or location along the discharge flow pathway 12*b*. In effect, the scope of the invention is intended to include the discharge casing insert borehole or orifice 12*d* and the discharge casing insert 14 being positioned or located anywhere in or along the discharge flow pathway 12*b* within the spirit of the present invention. In other words, the scope of the invention is not intended to be limited to any particular position or location of the discharge casing insert borehole or orifice 12*d* and the discharge casing insert 14 in or along the discharge flow pathway 12*b*.

In FIGS. 1A and 1B, the discharge casing 12 is understood to include other parts and components, as a person skilled in the art would appreciate, e.g., that do not necessarily form part of the underlying invention and are not described in further detail.

FIGS. 2-3: Dowel Pin Arrangements

In FIGS. 2-3, the discharge casing insert 14 may include, or take the form of, the discharge casing Venturi plug portion 14*a* configured with a dowel pin bore 14*d*, e.g., that may be axially drilled into its far end, to receive the dowel pin 14*b*', 14*b*", so as to configure the restricted discharge flow pathway 14*a*' (FIG. 2A), 14*a*" (FIG. 3A) to provide the partial obstruction in the discharge flow pathway 12*b* and the flow of the effluent being pumped and discharged. In FIGS. 2A, 3A and 3B, the arrows and reference labels 14*a*', 14*a*" point to the restricted discharge flow pathway, for providing the partial obstruction in the discharge flow pathway 12*b* and the flow of the effluent being pumped and discharged from the discharge casing.

In FIG. 2, the dowel pin 14*b*' may be arranged in the dowel pin bore 14*d*, so as to restrict some part (e.g., an intermediate or middle part) of the corresponding discharge flow pathway 14*c* and provide the partial obstruction in the discharge flow pathway 12*b* and the flow of the effluent being pumped and discharged. In some embodiments, the dowel pin 14*b*' may be configured as a rod (e.g., a solid rod) having a shaft with a reduced diameter that is less than the cross-section of the discharge flow pathway 12*b*, so as to restrict some part of the corresponding discharge flow pathway 14*c* and provide the partial obstruction in the discharge flow pathway 12*b* and the flow of the effluent being pumped and discharged. (By way of example, embodiments are envisioned, wherein some portion of shaft may be configured with the reduced diameter, and other portions of the shaft may have a different diameter, e.g., a larger diameter.)

In FIG. 3, alternatively the dowel pin 14*b*" may be configured or formed with an orifice (or opening) 14*d*' having a reduced cross-section that is less than the cross-section of the discharge flow pathway 12*b*, so as to restrict some part of the corresponding discharge flow pathway 14*c* and provide the partial obstruction in the discharge flow pathway 12*b* and the flow of the effluent being pumped and discharged.

The discharge casing insert 14 may include a set of dowel pins 14*b*', 14*b*", where each dowel pin may be configured to be received in the dowel pin bore 14*d*, and where each dowel pin may also be configured to provide a different-sized partial obstruction in the discharge flow pathway 12*b* and the flow of the effluent being pumped and discharged, so that performance of the pump may be adjusted based upon the selection of which dowel pin is used from the set of dowel pins so as to provide a desired throat area.

In some embodiments, each dowel pin 14*b*' may be configured with a respective shaft having a different diameter, where a dowel pin having a larger diameter causes a larger partial obstruction in the discharge flow pathway 12*b* and the flow of the effluent being pumped and discharged, and where a corresponding dowel pin having a smaller diameter causes a smaller partial obstruction in the discharge flow pathway 12*b* and the flow of the effluent being pumped and discharged.

Alternatively, each dowel pin 14*b*" may be configured with a respective orifice having a respective diameter that causes a respective partial obstruction in the discharge flow pathway 12*b* and the flow of the effluent being pumped and discharged. By way of example, the set of dowel pins may include a first dowel pin having a first orifice with a first diameter that causes a first partial obstruction in the discharge flow pathway 12*b* and the flow of the effluent being pumped and discharged, and may include a second dowel pin having a second orifice with a second diameter that is different from the first diameter and that causes a different-sized partial obstruction than the first partial obstruction in the discharge flow pathway 12*b* and the flow of the effluent being pumped and discharged.

The scope of the invention is not intended to be limited to any particular diameter(s) of the shaft or the orifice of the dowel pin.

FIGS. 4-5: Integrally Formed Restricted Inlet/Opening Arrangements

In FIGS. 4 and 5, the discharge casing insert 140 may include, or take the form of, the discharge casing Venturi plug portion 140*a* configured with an inlet/opening 140*d*', 140*d*" that may be drilled or integrally formed therein, e.g., for providing the partial obstruction in the discharge flow pathway 12*b* and the flow of the effluent being pumped and discharged from the discharge casing.

By way of example, the inlet/opening 140*d*', 140*d*" may be configured or formed having a reduced cross-section that is less than the cross-section of the discharge flow pathway 12*b*, so as to restrict some part of the corresponding discharge flow pathway 140*c* and provide the partial obstruction in the discharge flow pathway 12*b* and the flow of the effluent being pumped and discharged.

In FIG. 4, the orifice 140*d*' may be configured, shaped or formed with an inlet portion 140*d*'(in) having a reduced cross-section that is less than the cross-section of the discharge flow pathway 12*b*, and with an expanding conical portion 140*d*'(out) having a cross-section that may be less than, substantially the same as, or larger than the cross-section of the discharge flow pathway 12*b*. Embodiments are also envisioned, and the scope of the invention is intended to include, the inlet portion 140*d*'(in) and the expanding conical portion 140*d*'(out), e.g. being reversed so the fluid flows in the opposite direction.

In FIG. 5, the orifice 140*d*" may be configured, shaped or formed with a first expanding portion 140*d*"(in) that may have a cross-section that is the same or larger than the cross-section of the discharge flow pathway 12*b*, with an inlet portion 140*d*"(restricted) having a reduced cross-section that is less than the cross-section of the discharge flow pathway 12*b*, and also with a second expanding conical portion 140*d*"(out) having a cross-section that may be less than, substantially the same as, or larger than the cross-section of the discharge flow pathway 12*b*.

Consistent with that set forth above, the apparatus 10 may include a set of discharge casing inserts 140, each discharge casing insert 140 having a respective Venturi plug portion 140*a*, where each discharge casing Venturi plug portion 140*a*" may be configured to be received in the discharge casing borehole 12*d*, and where each discharge casing Venturi plug portion 140*a* may also be configured to provide a different-sized partial obstruction in the discharge flow pathway 12*b* and the flow of the effluent being pumped and discharged, so that performance of the pump may be adjusted based upon the selection of which discharge casing Venturi plug portion 140*a* is used from the set so as to provide a desired throat area.

In some embodiments, each discharge casing Venturi plug portion 140*a* may be configured with a respective orifice having a respective different diameter that causes a respective partial obstruction in the discharge flow pathway 12*b* and the flow of the effluent being pumped and discharged. For example, the set of discharge casing inserts may include a first discharge casing Venturi plug portion 140*a* having a first diameter orifice that causes a first partial obstruction in the discharge flow pathway 12*b* and the flow of the effluent being pumped and discharged, and may also include a second discharge casing Venturi plug portion 140*a* having a second orifice with a second diameter that is different from the first diameter and that causes a different-sized partial obstruction in the discharge flow pathway 12*b* and the flow of the effluent being pumped and discharged.

The scope of the invention is not intended to be limited to the diameter of the orifice.

Other Features

The discharge casing insert 14, 140 may include a flange portion 14*e*, 140*e*', 140*e*" for assembling the discharge casing insert 14, 140 to the discharge casing 12, including where the flange portion 14*e*, 140*e*, 140*e*" is configured with multiple drilled openings 14*e*1, 14*e*2, 14*e*3, 14*e*4, 14*e*5, 14*e*6, 14*e*'1, 140*e*'1, 14*e*'2, 140*e*"1, 140*e*"2, e.g., some of which may be configured to inserting or removing the discharge casing insert 14 to and from the discharge casing 12.

The discharge casing insert 14, 140 may be configured to be removable and replaceable. For example, the discharge casing insert borehole 12*d* may be configured with threads (not shown); and the discharge casing Venturi plug portion 14*a*, 140*a* may be configured with corresponding threads (not shown), so that the discharge casing insert 14, 140 can be screwed into, or screwed out from, the discharge casing 12 so as to be removable and replaceable as needed.

The discharge casing 12 may be configured with a recess 12*f*; and the discharge casing insert 14, 140 may include a sealing washer 14*g* configured to be received in the recess 12*f* of the discharge casing 12 to seal the discharge casing 12 when the discharge casing insert 14, 140 is screwed into the discharge casing 12.

The restricted discharge flow pathway 14*a*', 14*a*", 140*a*', 140*a*" may be configured with a geometry that may include, but is not limited to, either a round shape, a triangular shape, a rectangular shape, a square shaped, or an oval shape, which effects pump performance. The scope of the invention is not intended to be limited to shape of the restricted discharge flow pathway, and is intended to include other types or kinds of shapes that are now known or later developed in the future.

The apparatus 10 may include the pump.

Possible Applications

Possible applications include at least the following:

Venturi-style pumps or pumps with relatively low specific needs, e.g., including pumps having Ns< or =1,000 (US Units)

By way of example, pump types may include OH1, OH2, OH3, OH4, OH6, BB1, BB2 and BB3

The Scope of the Invention

It should be understood that, unless stated otherwise herein, any of the features, characteristics, alternatives or modifications described regarding a particular embodiment herein may also be applied, used, or incorporated with any other embodiment described herein. Also, the drawing herein is not drawn to scale.

Although the invention has been described and illustrated with respect to exemplary embodiments thereof, the foregoing and various other additions and omissions may be made therein and thereto without departing from the spirit and scope of the present invention.

We claim:

1. An apparatus that includes a pump, the apparatus comprising:

a discharge casing configured with a discharge flow pathway to provide a flow of effluent being pumped and discharged, wherein the discharge flow pathway has a discharge flow pathway wall, and wherein the discharge casing is also configured with a discharge casing insert borehole that passes from an outer surface of the discharge casing through the discharge flow pathway wall and into the discharge casing; and a discharge casing insert that includes a discharge casing Venturi plug portion, wherein the discharge casing insert is arranged from the outer surface of the discharge casing, through the discharge casing borehole in the discharge flow pathway, and into the discharge casing, wherein the discharge casing Venturi plug portion configured with a restricted discharge flow pathway to provide a partial obstruction in the discharge flow pathway and the flow of the effluent being pumped and discharged;

wherein the discharge casing insert further includes a flange portion with an opening where the flange portion is coupled to the outer surface of the discharge casing, and wherein the discharge casing further comprises a discharge casing annulus and is further configured with a recess that fits a sealing washer of the discharge casing insert so as to seal the discharge casing when the discharge casing insert is coupled to the discharge casing.

2. The apparatus according to claim 1, wherein:

the discharge casing Venturi plug portion is configured with a dowel pin bore, and the discharge casing Venturi plug portion comprises a dowel pin configured to be received in the dowel pin bore, so as to configure the restricted discharge flow pathway to provide the partial obstruction in the discharge flow pathway and the flow of the effluent being pumped and discharged.

3. The apparatus according to claim 2, wherein:

the discharge flow pathway has a cross-section, and the discharge casing Venturi plug portion is configured with a corresponding discharge flow pathway, one part or section of which has a corresponding cross-section that is substantially same as the cross-section of the discharge flow pathway, and another part or section of which has a reduced cross-section that is less than the cross-section of the discharge flow pathway.

4. The apparatus according to claim 3, wherein the dowel pin is arranged in the dowel pin bore, so as to restrict some part of a corresponding discharge flow pathway and provide the partial obstruction in the discharge flow pathway and the flow of the effluent being pumped and discharged.

5. The apparatus according to claim 3, wherein the dowel pin is configured as a rod, including a solid rod, having a shaft with a reduced diameter that is less than the cross-section of the discharge flow pathway, so as to restrict some part or section of a corresponding discharge flow pathway and provide the partial obstruction in the discharge flow pathway and the flow of the effluent being pumped and discharged.

6. The apparatus according to claim 3, wherein the dowel pin is configured with an orifice having a reduced cross-section that is less than the cross-section of the discharge flow pathway, so as to restrict some part or section of a corresponding discharge flow pathway and provide the partial obstruction in the discharge flow pathway and the flow of the effluent being pumped and discharged.

7. The apparatus according to claim 2, wherein:

the discharge casing insert comprises a set of dowel pins, each dowel pin is configured to be received in the dowel pin bore, and each dowel pin is configured to provide a respective different-sized partial obstruction in the discharge flow pathway and the flow of the effluent being pumped and discharged, so that performance of the pump may be adjusted based upon selection of which dowel pin is used from the set of dowel pins so as to provide a particular throat area.

8. The apparatus according to claim 7, wherein:

each dowel pin is configured with a respective shaft having a different diameter, a dowel pin having a larger diameter causes a larger partial obstruction in the discharge flow pathway and the flow of the effluent being pumped and discharged, and a dowel pin having a smaller diameter causes a smaller partial obstruction in the discharge flow pathway and the flow of the effluent being pumped and discharged.

9. The apparatus according to claim 7, wherein:

each dowel pin is configured with a respective orifice having a respective diameter that causes a respective partial obstruction in the discharge flow pathway and the flow of the effluent being pumped and discharged, and the set of dowel pins comprises a first dowel pin having a first orifice with a first diameter that causes a first partial obstruction in the discharge flow pathway and the flow of the effluent being pumped and discharged, and comprises a second dowel pin having a second orifice with a second diameter that is different from the first diameter and that causes a different-sized partial obstruction in the discharge flow pathway and the flow of the effluent being pumped and discharged.

10. The apparatus according to claim 1, wherein the discharge casing Venturi plug portion is configured with an orifice that is drilled or integrally formed therein, to provide the partial obstruction in the discharge flow pathway and the flow of the effluent being pumped and discharged from the discharge casing.

11. The apparatus according to claim 10, wherein the orifice is configured or formed with a portion thereof having a reduced cross-section that is less than a cross-section of the discharge flow pathway, so as to restrict some part or section of the corresponding discharge flow pathway and provide the partial obstruction in the discharge flow pathway and the flow of the effluent being pumped and discharged.

12. The apparatus according to claim 10, wherein the orifice is configured, shaped or formed with a portion having a reduced cross-section that is less than a cross-section of the discharge flow pathway, and an expanding conical portion having a cross-section that is less than, same as, or larger than the cross-section of the discharge flow pathway.

13. The apparatus according to claim 10, wherein the orifice is configured, shaped or formed with:

an expanding portion having a cross-section that is less than, substantially same as or larger than a cross-section of the discharge flow pathway, a portion having a reduced cross-section that is less than the cross-section of the discharge flow pathway, and an expanding conical portion having a cross-section that is less than, same as, or larger than the cross-section of the discharge flow pathway.

14. The apparatus according to claim 10, wherein:

the apparatus comprises a set of discharge casing inserts, each discharge casing insert has a respective discharge casing Venturi plug portion, each discharge casing Venturi plug portion is configured to be received in the discharge casing insert borehole, and each discharge casing Venturi plug portion is configured to provide a different-sized partial obstruction in the discharge flow pathway and the flow of the effluent being pumped and discharged, so that performance of the pump may be adjusted based upon selection of which discharge casing Venturi plug portion is used from the set so as to provide a particular throat area.

15. The apparatus according to claim 14, wherein:

each discharge casing Venturi plug portion is configured with a respective orifice having a respective diameter that causes a respective partial obstruction in the discharge flow pathway and the flow of the effluent being pumped and discharged, and the set of discharge casing inserts comprises a first discharge casing Venturi plug portion having a first orifice with a first diameter that causes a first partial obstruction in the discharge flow pathway and the flow of the effluent being pumped and discharged, and comprises a second discharge casing Venturi plug portion having a second orifice with a second diameter that is different from the first diameter and that causes a different-sized partial obstruction in the discharge flow pathway and the flow of the effluent being pumped and discharged.

16. The apparatus according to claim 1, wherein the discharge casing insert is configured to be removable and replaceable.

17. The apparatus according to claim 1, wherein:

the discharge casing insert borehole is configured with threads, and the discharge casing Venturi plug portion is configured with corresponding threads, so that the discharge casing insert can be screwed into the discharge casing so as to be removable and replaceable.

18. The apparatus according to claim 1, wherein the restricted discharge flow pathway is configured with a geometry that includes either a round shape, a triangular shape, a rectangular shape, a square shaped, or an oval shape, which affects pump performance.

19. The apparatus of claim 1, wherein the restricted discharge flow pathway of the discharge casing Venturi plug portion comprises:

an inlet having a cross-section that is the same size as or larger than a cross-section of the discharge flow pathway;

an outlet having a cross-section that is the same size as or larger than the cross-section of the discharge flow pathway; and at least one section of the restricted discharge flow pathway of the discharge casing Venturi plug portion has a reduced cross-section that is less than the cross-section of the discharge flow pathway.

* * * * *